United States Patent [19]

Morell

[11] Patent Number: 4,974,856

[45] Date of Patent: Dec. 4, 1990

[54] GOLF BALL

[75] Inventor: Joseph Morell, Annecy, France

[73] Assignee: Salomon S.A., Annecy, France

[21] Appl. No.: 442,228

[22] Filed: Nov. 28, 1989

[30] Foreign Application Priority Data

Nov. 29, 1988 [FR] France ..... 88 15570

[51] Int. Cl.[5] ..... A63B 37/12; A63B 37/14

[52] U.S. Cl. ..... 273/232; 40/327

[58] Field of Search ..... 273/232; 40/327

[56] References Cited

U.S. PATENT DOCUMENTS 4,762,326 8/1988 Gobush ..... 273/232

4,844,472 7/1989 Ihara ..... 273/232

*Primary Examiner*—George J. Marlo

[57] ABSTRACT

The present invention relates to a golf ball.

The peripheral surface (2) of the ball has dimples defining by their intersections with this peripheral surface (2) intersection circles (55,57,59,60,64,68,70) which, in their majority (55,57,59,60,64,68), are distributed essentially inside 24 identical elemental surfaces (40) in spherical isosceles right-angle triangle form, and 8 second identical elemental surfaces (45) in spherical equilateral triangle form, which elemental surfaces (40,45) are defined by 4 equatorial circles (36,37,39) of the sphere defining the general shape of the peripheral surface (2) of the ball (3), eahc of the equilateral triangle (36,37,39) being centered on an axis passing through two diametrically opposed apices of a cube inscribed in this sphere, and by 3 equatorial circles (29,30,31) of this sphere, which are centered on axes passing through the respective centers of two diametrically opposed surfaces of the cube; the determined one (29) of these equatorial circles nevertheless cuts none of the intersection circles and subdivides the other equatorial circles (30,31,36,37,39) into two circular arcs which mutually cut at points (49,50) of the peripheral surface (2); at least one of these intersection circles is disposed about a respective one of these points (49,50).

The orientation of the ball with respect to the strike can thus be rendered substantially independent, while a strike on the said determined equatorial circle is avoided.

17 Claims, 2 Drawing Sheets

GOLF BALL

The present invention relates to a golf ball, of the type having a peripheral surface having the general shape of a sphere and a plurality of dimples arranged in the said peripheral surface and defining by their intersections with this intersection circles distributed on the said peripheral surface in accordance with a motif determined by subdivision of the said peripheral surface along:

3 equatorial circles of which each is centred on an axis passing through the respective centres of two diametrically opposed faces of a cube inscribed in the sphere, 4 equatorial circles of which each is centred on an axis passing through two diametrically opposed apices of the cube:

in a manner to define 24 first identical elemental surfaces in spherical isosceles right-angle triangle form and 8 second identical elemental surfaces in spherical equilateral triangle form, the said intersection circles being distributed essentially inside the said first and second elemental surfaces, at least one determined equatorial circle, amongst the said equatorial circles, cutting none of the intersection circles and subdividing each of the others of the said equatorial circles into two equatorial circular arcs, of which each corresponds to one of the two hemispheres defined by the said determined equatorial circle, the said equatorial circular arcs mutually cutting each other in pairs or threes at determined points of intersection on each hemisphere.

A golf ball of this type is described in U.S. Pat. No. 4,762,326 which proposes a certain number of motifs for distribution of intersection circles inside the elemental surfaces.

It should be noted that, in a general manner, these known motifs allow the existence locally, on the peripheral surface of the golf ball, of relatively significant areas, devoid of dimples, so that the player is obliged to carefully orient his ball before striking it if he wishes to benefit from a significant probability of hitting the peripheral surface of the ball in zones of this surface having a substantially identical geometry for each strike, in order to ensure the reproduceability of the strikes.

The object of the present invention is to remedy this inconvenience by proposing a mode of distribution of intersection dimples on the peripheral surface of the ball permitting reduction as far as possible of the areas of this peripheral surface existing between the intersection circles.

For this, the present invention proposes a golf ball of the type indicated in the preamble, further characterised in that at least one intersection circle is arranged about a respective one of the said points of intersection of 3 equatorial circular arcs.

Preferably, an intersection circle is also positioned respectively about each of the points of intersection of 3 equatorial circular arcs, this allied to a judicious choice of motif for distribution of intersection circles inside each elemental surface, permits the obtaining of a covering as complete as possible of the peripheral surface of the golf ball by intersection circles, that is to say by the dimples; thus, the player concerned always to strike the ball in zones having a substantially identical geometry need be concerned only, before each strike, to check that the orientation of the ball is not such that the strike hits the peripheral surface of the latter in the region of the said determined equatorial circle, the only eventuality causing the need for reorientation of the ball.

Naturally, only certain points of intersection of 3 equatorial circular arcs can have a dimple, that is to say a circle of intersection of such a dimple with the peripheral surface of the golf ball, one of them or several of them being able to retain the shape of an area intermediary between intersection circles arranged inside respective elemental surfaces as the mentioned U.S. patent proposes, or to have the form of a flat, for receiving for example a manufacturer's mark; certainly, such a choice meets the desired object of the present invention in that it can oblige the player to reorient his ball more often than when each point of intersection of 3 equatorial circular arcs has an intersection circle, but this inconvenience remains limited to the extent that the number of points of intersection of 3 equatorial circular arcs thus devoid of intersection circles itself remains limited.

It should be noted that putting the present invention into effect does not involve difficulty in manufacture of the ball, because one of the mentioned equatorial circles, that is to say the said determined equatorial circle cuts none of the circles of intersection of a dimple with the peripheral surface of the golf ball. This determined equatorial circle can in fact correspond to a joint plane when the ball is made by assembly of two identical halves or when at least one surface layer of this, comprising the dimples, is made by moulding in a single piece in a mould itself formed of two assembled identical halves, which correspond to known methods of manufacture, of which the simplicity and economy of operation are also known.

To compensate for the absence of intersection circles on this determined equatorial circle, that is to say to reduce any disadvantage from this absence of areas of the spherical peripheral surface existing in this region between the intersection circles, it can be provided that the equatorial circular arcs of one of the hemispheres are angularly displaced, with respect to the respectively corresponding equatorial circular arcs of the other of the hemispheres, by the same amount about the axis of the said determined equatorial circle; naturally, this notion of angular displacement is intended to be with reference to the geometrical construction of the subdivision of the peripheral surface of the ball into elemental surfaces; for example, if the said determined equatorial circle is centred on an axis passing through the respective centres of two diametrically opposed faces of the cube, the said value is advantageously 45° so that each equatorial circular arc of one of the hemispheres is connected to an equatorial circular arc of the other of the hemispheres on the said determined equatorial circle, these two circular arcs corresponding in fact to different equatorial circles.

Preferably those of the intersection circles which are not situated at the intersection of 3 equatorial circular arcs are distributed according to an identical motif in the identical elemental surfaces, the said motif being preferably chosen in a manner to ensure a distribution as homogeneous as possible of areas of the peripheral surfaces of the ball existing between the intersection circles.

For this, there can be chosen for the distribution of intersection circles in a first elemental surface a motif based on the motif illustrated in FIG. 9 of the mentioned U.S. patent, which motif has several mutually neighbouring rows of which a first is adjacent to the hypothenuse of the spherical right-angle triangle and of which each mutually connects the two sides of the right angle of the spherical right-angle triangle and has a respective determined number of regularly distributed intersection circles of the same diameter, this determined number being for each row one unit less than the determined number of intersection circles in the respectively neighbouring row nearer the hypothenuse and each intersection circle of each row being adjacent in pairs of intersection circles of the respectively neighbouring row nearer the hypothenuse. Nevertheless, instead of both giving the same diameter to all the intersection circles thus arranged in the same elemental surface and of preserving a significant spacing between the intersection circles of the first row, as is recommended with reference to FIG. 9 of the mentioned U.S. patent, it is preferred according to the present invention that the said first row has four mutually adjacent intersection circles, adjacent to the hypothenuse of the spherical right-angle triangle and of which two end intersection circles are also adjacent respectively to one and the other of the sides of the right angle the spherical right-angle triangle, that the said rows further comprise:

- a second row of three mutually disjoint intersection circles, of which each is adjacent to two intersection circles of the first row and of which two end intersection circles are further respectively adjacent to the one and the other of the sides of the right angle of the spherical right-angle triangle,
- a third row of two mutually disjoint intersection circles, of which each is adjacent to two intersection circles of the second row and respectively to the one and the other of the sides of the right angle of the spherical right-angle triangle,
- a single intersection circle adjacent to the two intersection circles of the third row and to the two sides of the right angle of the spherical right-angle triangle,
- and that the respective diameters of the intersection circles of the second and third rows and of the single intersection circle are substantially identical and less than the diameter of the intersection circles of the first row.

As regards the distribution of intersection circles in a second elemental surface, a motif can also be chosen which is based on the motif illustrated in FIG. 9 of the mentioned U.S. patent; if there is defined as a median circular arc of a second elemental surface an arc centred on the centre of the sphere and joining the apex of the said spherical equilateral triangle to the midpoint of the opposite side of the this, the mentioned motif of the U.S. patent has first intersection circles distributed in an identical manner on the median circular arcs and second intersection circles distributed in rows of which each mutually connects two first intersection circles occupying identical positions on the said corresponding median circular arcs, the diameters of these first and second intersection circles preferably being identical; for example, a second elemental surface can thus comprise 15 identical intersection circles distributed in three rows each passing along a respective side of the spherical equilateral triangle and comprising five intersection circles adjacent in pairs and adjacent this side, two end intersection circles of each of these rows being common to two respective others of these rows and being adjacent to two other respective sides of the spherical equilateral triangle and in three intersection circles adjacent in pairs and of which each is further adjacent to two respective intersection circles of two of the said three rows.

One can reduce to a minimum the areas of the peripheral surface of the golf ball existing between two intersection circles, inside each elemental surface as well as from one intersection surface to another, by providing that the diameter of the intersection circles of a second elemental surface are intermediary between the respective diameters of the intersection circles of the first row of a first elemental surface and of the intersection circles of the second and third rows of a first elemental surface; also to this end, the intersection circles situated around a respective one of a point of intersection of 3 equatorial circles is preferably given such a diameter that it is adjacent to two intersection circles of which each is situated in a respective one of the said second elemental surfaces and constitutes in this second elemental surface one of the said first intersection circles or the said end intersection circles, respectively.

Other characteristics and advantages of a ball according to the present invention will appear from the description below of two non-limitative examples, as well as from the accompanying drawings which form an integral part of this description.

Figure 2:
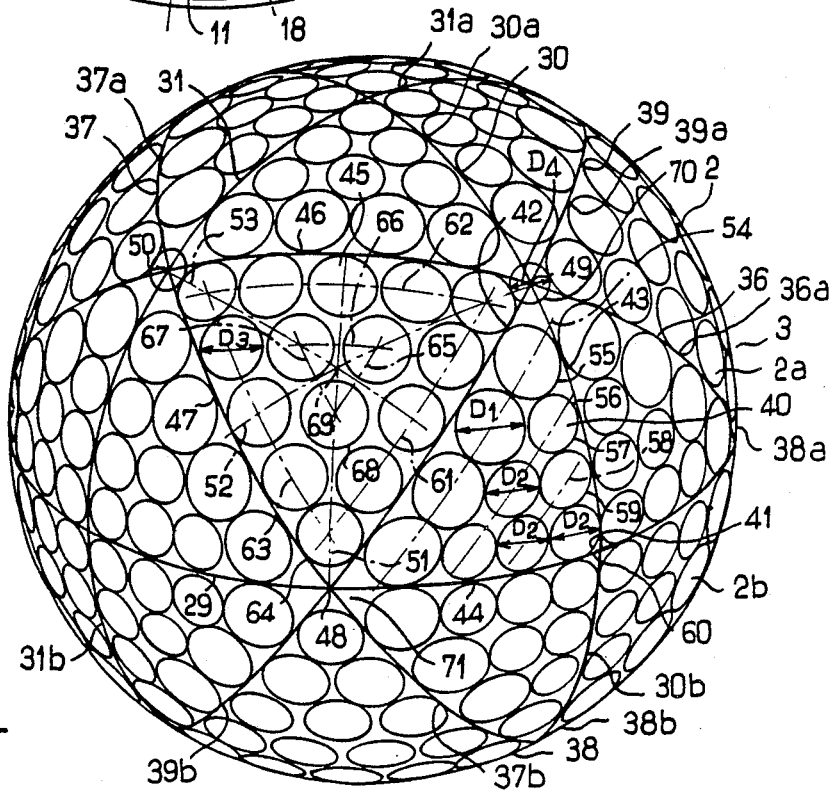
FIG. 2 shows a golf ball of which the dimples, or more precisely the circles of intersection of these dimples with the peripheral surface of the ball, are distributed according to the present invention.
Figure 3:
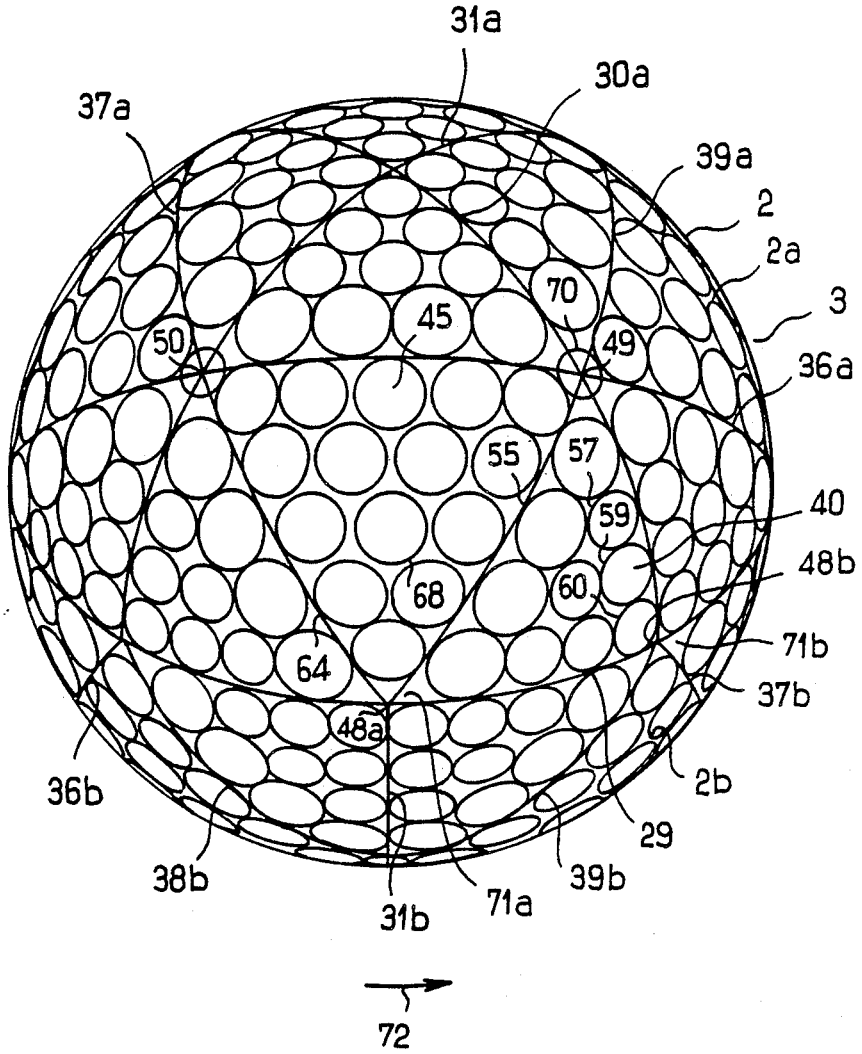

FIG. 3 shows a golf ball in all respects analogous to that of FIG. 2 except that one of the hemispheres defined by this equatorial circle which cuts none of the intersection circles, that is to say an equatorial circle centred on an axis passing through respective centres of two diametrically opposed faces of the cube inscribed in the sphere, is angularly displaced by 45° with respect to the other of the said hemispheres, about the axis of this equatorial circle.

Figure 1:
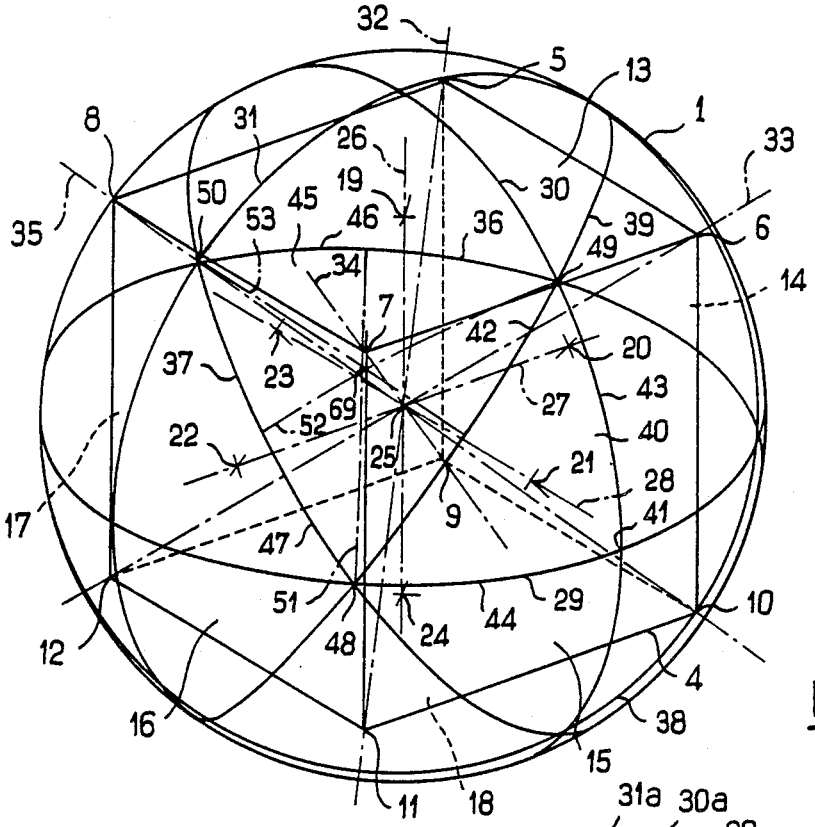
FIG. 1 illustrates the construction, according to the present invention, of 7 equatorial circles on a sphere from a cube inscribed in this latter.

Referring in the first place to FIG. 1 where there is designated by 1 a sphere having; the general shape of the peripheral surface 2 of a golf ball 3 illustrated in FIG. 2, and by 4 a cube inscribed in this sphere 1 on which it has 8 apices 5 to 12 connected in pairs by 12 non-referenced edges which, in fours, define 6 square faces 13 to 18 of which each has a centre 19 to 24; the cube 4 itself and the sphere 1 having a common centre 25 which will serve as a reference when referring below to the notation of diametrically opposed positions.

For geometrical reasons, the respective centres of two diametrically opposed faces of the cube 4 are distributed into three groups of two diametrically opposed centres, that is to say the centres 19 and 24, 20 and 22, 21 and 23; for putting into effect the present invention, there is defined by the two centres of each of these groups an axis, respectively 26,27,28 and, about this axis, there is set out on the sphere a respective equatorial circle 29,30,31; the three equatorial circles 29,30,31 have been shown on the peripheral surface 2 of the ball 3 in FIG. 2, although they are not necessarily reproduced in material form in this latter.

Also for geometrical reasons, the apices of the cube 4 are distributed for their part in four groups of two diametrically opposed apices and FIG. 1 shows the presence of 4 axes 32,33,34,35 of which each passes through two diametrically opposed apices of the cube 4, that is to say respectively the apices 5 and 11, 6 and 12, 7 and 9, 8 and 10.

About each of these axes 32 to 35 is set out on the sphere 1 a respective equatorial circle 36,37,38,39; there is also shown in FIG. 2 on the peripheral surface 2 of the ball 3, the three most visible of these equatorial circles 36 to 39 as defined which, nevertheless, are not necessarily reproduced in material form on this surface 2.

The 4 equatorial circles 36 to 39 define with the 3 considered equatorial circle 29 to 31 in pairs 24 identical elemental surfaces in spherical isosceles right-angle triangle form, mutually symmetrical with respect to 3 equatorial circles 29 to 31 and of which there is designated the right angle by 41, the hypothenuse by 42 and the two sides of the right angle 41 by 43 and 44.

In threes, the 4 equatorial circles 36,37,38,39 delimit between themselves 8 identical elemental surfaces in spherical equilateral triangle form, which are regularly distributed on the sphere 1, mutually symmetrically with respect to the 3 equatorial circles 29 to 31 and are thus delimited by 3 sides 42,46,47 of which each also constitutes the hypothenuse of a respective spherical isosceles right-angle triangle such as 40; there are designated by 48,49,50 three apices of a spherical equilateral triangle 45, each of these apices reproducing the intersection of 3 equatorial circles of which two are centred on an axis passing through two diametrically opposed apices of the cube 4 and of which the third is centred on an axis passing through the respective centres of two diametrically opposed faces of the cube 4.

There will be found on the elemental surfaces 40,45, their parts 41 to 44 and 42 to 50 in FIG. 2 where there are also shown, as well as in FIG. 1, three circular arcs 51,52,53 of the sphere 1, on the centre 25 of which these circular arcs are centred. Each of these three circular arcs 51,52,53 connects a respective apex 48,49,50 of an equatorial triangle 45 to the midpoint of the respective opposite side of this 46,47,42 respectively, these circular arcs 48,49,50 are designated below as median circular arcs of the elemental surface in equilateral triangle form 45.

In a manner known in itself, in the spherical peripheral surface 2 of the ball 3 are arranged dimples which have for example the shape of part-spherical depressions and define circles by their intersection with this peripheral surface 2.

In their majority, the intersection circles thus defined are distributed according to respectively determined motifs inside the elemental surfaces 40 and inside the elemental surfaces 45, without overlapping any of the equatorial circles in the three examples illustrated although such overlapping is permissible to a certain extent; nevertheless, in the interests of production of the present invention, at least one of these equatorial circles, that is to say the circle 29, cuts none of the circles of intersection of the dimples with peripheral surface 2 of the ball 3, to correspond to a joint plane between two halves of the ball if this is made in two halves, or between two halves of a mould intended for the production of the ball, or at least of a surface layer of this having the dimples, in a single piece by moulding; preferably, and without departing from the scope of the present invention in adopting a different arrangement, the motif of distribution of the dimples, that is to say of the circles of intersection of these latter with the peripheral surface of the ball, is identical from one elemental surface to another, as is the motif for distribution of the dimples or the intersection circles in the elemental surfaces 45; more precisely the embodiment illustrated in FIG. 2 reproduces all the preferred arrangements, in a manner which will now be described in more detail, In this case, in each elemental surface 40, the circles of intersection of the dimples with the spherical peripheral surface 2 of the ball 3 are distributed in the following manner:

- a first row 54 of 4 mutually identical intersection circles 53, that is to say with the same diameter $D_1$ chosen so that the 4 circles of this row are adjacent in pairs and adjacent to the hypothenuse 42 of the elemental surface 40, and so that each of the end circles 55 of this row 54, are further adjacent to a respective one of the two sides 43 and 44 of the right angle 41; the diameter $D_1$ can be easily determined for this by a man skilled in the art;
- a second row 56 comprising three identical circles 57, that is to say with the same diameter $D_2$ less than the diameter $D_1$ and chosen, in a manner easily determinable by a man skilled in the art, so that the circles 57 are mutuallY disjoint but are adjacent to two respective ones of the circles 55 of the first row, situated between the row 56 and the hypothenuse 42 of the elemental surface 40, and that each of the end circles 57 of the row 56 are further adjacent to a respective one of the two sides 43 and 44 of the right angle 41;
- a third row 58 of two circles 59 of the same diameter $D_2$ as the circles 57 of the second row 56, which diameter is in addition chosen so that the two circles 59 of the row 58 are mutually disjoint but adjacent to two respective ones of the circles 57 of the second row 56 nearer to the hypothenuse 42 and that each of the circles 59 is adjacent to a respective one of the sides 43 and 44 of the right angle 41;
- a single intersection circle 60 of the same diameter $D_2$ as the circles 57 and 59, which is in addition such that the circle 60 is tangential at once to the circles 59 of the second row 58 and to the two sides 43 and 44 of the right angle 41; the diameter $D_2$ can easily be determined, from the arrangement of the previously described relative positions of the circles 55,57,59,60, by a man skilled in the art.

In a general manner, in the preceding description as well as below, there is intended by the term "adjacent" with respect to circles of intersection of a dimple with the peripheral surface 2 of the ball 3, either in pairs or with respect to a side delimiting the elemental surface which essentially contains them, a tangential arrangement or a mutual spacing such that it is small with respect to the diameter of the circles concerned, and for example at the most equal to a quarter of the diameter, this figure being given by way of non-limitative example.

In each elemental surface 45, and in the case of the embodiment illustrated in FIG. 2, the circles of intersection of the dimples with the peripheral surface 2 of the ball 3 have the same diameter $D_3$ intermediate between the diameters $D_1$ and $D_2$ and distributed in the following manner:

- 3 identical rows 61,62,63 of 5 identical circles 64 of which the diameter $D_3$ is chosen so that, in each row 61, 62,63 the circles 64 are mutually adjacent and are adjacent to an edge 42,46,47 respectively neighbouring the row 61,62, 63 to which these circles 64 belong; further, the two end circles of each of the rows 61,62,63 are centred on a respective median circular arc 51,52,53 of the elemental surface 45, and are common to two of the rows 61,62,63;

3 identical rows 65,66,67 each having 2 identical circles 68 of diameter $D_3$, these 2 circles being centred or a respective one of the median circular arcs 51,52,53 of the elemental surface 45 and these circles 68 being mutual adjacent in pairs as well as to four of the circles 64 belonging to two different rows 61,62,63, and more precisely to two respective circles 64 of two of the three rows 61,62, 63.

It will be noted that, on each of the median circular arcs 51,52,53, the circles 64 and 68 are distributed in an identical manner, at a rate of one circle 64 and of one circle 68 between each of the apices 48,49,50 of the elemental surface 45 and a point 69 defined as the point of intersection of the three median circular arcs 51,52,53 of this surface and of a circle 64 between each of the sides 42,46,47 of the elemental surface 45 and this point of intersection 69.

As with the diameters $D_1$ and $D_2$, the diameter $D_3$ can be easily determined by a man skilled in the art, as a function of the diameter of the peripheral surface 2 of the ball 3.

Further in accordance with the present invention, dimples produced by circles 70 of intersection with the peripheral surface 2 of the ball 3 are arranged respectively about certain of the mutual intersections of the equatorial circles 30,31,36,37,38,39, the intersections of these latter with the equatorial circle 29 remaining on the contrary devoid of dimples.

More precisely, if there are designated respectively by **2*a* and 2*b* two hemispheres, defined on the peripheral surface 2 of the ball 3 by the equatorial circle 29, this circle 29 subdivides each of the other equatorial circles 30,31,36,37,38,39 into two circular arcs, in practice semi-circles respectively 30*a* and 30*b*, 31*a* and 31*b*, 36*a* and 36*b* (visible only in FIG. 3 which will be described below), 37*a* and 37*b*, 38*a* and 38*b*, 39*a* and 39*b*, of which each is situated on a respective one of the said hemispheres 2*a* and 2*b*; on each of these hemispheres, the respectively corresponding equatorial circular arcs mutually cut each other on the one hand in pairs at non-referenced points corresponding respectively to the apex of the right-angle triangle such as 41 of certain elemental surfaces 40, and on the other hand, in threes at points which correspond to those of the apices such as 48,49,50 of the elemental surfaces 45 which are not situated on the equatorial circle 29, that is to say at four respective points for each of the hemispheres 2*a* and 2*b*; the only ones of these latter points which are visible in FIG. 2 are two apices 49 and 50 of an elemental surface 45 situated in the hemisphere 2*a*, at which respectively the circular arc 30*a*,36*a*,39*a* and the circular arcs three 31*a*,36*a* and 37*a* cross; in a non-visible manner, two others of these points are defined on the hemisphere 2*a* respectively by the intersection of circular arcs 30*a*,37*a*,38*a* and by the intersection of circular arcs 31*a*,38*a*,39*a*; in a manner also not visible, four others of these points are defined on the hemisphere 2*b* respectively by the intersection of the circular arcs 30*b*,36*b*,39*b*, by the intersection of circular arcs 31*b*,36*b*,37*b*, the intersection of circular arcs 30*b*,37*b*,38*b*, and the intersection of circular arcs 31*b*,38*b*,39*b***.

Preferably, a circle 70 of intersection of a dimple with the peripheral surface 2 is arranged respectively about each of the points of intersection of the 3 mentioned equatorial circular arcs, that is to say if one refers to FIG. 2, about each of the apices 49 and 50 of the elemental surface 45 which are not situated on the equatorial circle 29 (in the case of the apex 48), it being understood that the man skilled in the art can easily deduce the arrangement of such circle's about the other points of intersection of 3 of the mentioned equatorial circles in the hemisphere **2*a* as well as in the hemisphere 2*b*; on the contrary, these points of intersection of these equatorial circular arcs which are situated on the circle 29 as in the case of the apex 48 of the elemental surface 45 illustrated in FIG. 2, remain devoid of such intersection circles, that is to say of dimples; preferably, each of the intersection circles 70 has a diameter $D_4$ such that it is adjacent to two intersection circles 64, of which each constitutes one of the end intersection circles of two of the rows such as 61,62,63 adjacent to the sides such as 42,46,47 of a respective elemental surface 45; the diameter $D_4$ is less than the diameter $D_2$ when the above described arrangement of intersection circles 55,57,59,60,64** is adopted, it being understood that this arrangement as well as the choice of diameters which follows, constitute only non-limitative examples.

It will appear from examination of FIG. 2, that the absence of any intersection circle on the equatorial circle 29 allows the existence, about each of the apices such as 48 of an elemental surface 45 which are situated on this equatorial circle 29, a relatively significant area 71 of the peripheral surface 2 of the ball 3. This area 71 can be used for marking the ball by the manufacturer but it can equally preferably be reduced by adopting a subdivision of the peripheral surface 2 of the ball 3 illustrated in FIG. 3.

This subdivision is geometrically constructed in the same manner as has been described with reference to FIG. 1 except that after having defined the equatorial circles 29 to 31 and 36 to 39, and the subdivision of each equatorial circle 30,31,36,37,38,39 into two circular arcs belonging to each of the hemispheres **2*a*,2*b* defined by the equatorial circles 29, respectively, all the equatorial circles of one of these hemispheres are angularly displaced by the same amount, about the axis 26 of the equatorial circle 29, and in the same direction 72 so that the subdivision of each hemisphere 2*a*,2*b* into elemental surfaces 40 and 45 remains unchanged with respect to that which has been described with reference to FIG. 2, and that there remain identical on each hemisphere 2*a* or 2*b*, in the case of the embodiment illustrated in FIG. 3, the elemental surfaces 40 and 45, the intersection circles 55,57,59,60,64,68 distributed in these and the intersection circles 70 situated about each of the respective points of intersection of 3 of the equatorial circular arcs 30*a*,31*a*,36*a*,37*a*,38*a* (not visible in FIG. 3), 39*a*, on the hemisphere 2*a* and 30*b* (not visible in FIG. 3) 31*b*,36*b*,37*b*,39*b* on the hemisphere 2*b*; nevertheless the two arcs of the same equatorial circle no longer meet on the equatorial circle 29, but if, as is illustrated in FIG. 3, the value of the relative angular displacement of the two hemispheres 2*a* and 2*b* is 45°, at a point 48*a* situated on the circle 29 and corresponding to an apex of one of the elemental surfaces 45 of the hemisphere 2*a* there meet for example the equatorial circular arcs 37*a*,39*a* and 31*b* whilst at a point 48*b* also situated on the circle 29, displaced by 45° in the direction 72 with respect to a point 48*a* and corresponding to an apex of an identical elemental surface to the elemental surface 45 but situated on the hemisphere 2*b*, there meet in this example the equatorial circular arcs 30*a*,37*b* and 39*b*; it should be noted that about each of the points 48***a* and 48*b* there exists a respective area 71*a*, 71*b* of the peripheral surface 2 of the ball 3 significantly less than the area 71 existing at 48 in the case of the embodiment of the invention illustrated in FIG. 2.

In a general manner, the embodiments of the invention which have been described constitute only non-limitative examples, with respect to which there can be provided numerous variants without departing from the scope of the present invention; in particular, certain of the intersection circles 70, four being provided per hemisphere 2*a* or 2*b* in the previously described preferred examples, or one amongst them only can be omitted and replaced for example by a respective flat for marking the ball by the manufacturer, which flat will be easily visible and consequently easy to avoid on striking.

I claim:

1. A golf ball comprising a peripheral surface having the general shape of a sphere and a plurality of dimples arranged in said peripheral surface and defining by their intersection with this circles of intersection distributed on said peripheral surface in accordance with a repetitive motif determined by subdivision of said peripheral surface along:

3 equatorial circles of which each is centred on an axis passing through respective centres of two diametrically opposed faces of a cube inscribed in said sphere, 4 equatorial circles of which each is centred on an axis passing through two diametrically opposed apices of said cube, in a manner to define 24 identical first elemental surfaces in the form of a spherical isosceles right-angle triangle and 8 second identical elemental surfaces in the form of a spherical equilateral triangle, said intersection circles being distributed essentially inside said first and second elemental surfaces, at least one determined one of said equatorial circles, cutting none of said intersection circles and subdividing each of the others of said equatorial circles into two equatorial circular arcs, of which each corresponds to one of two hemispheres defined by said determined equatorial circle, said equatorial circular arcs cutting each other in pairs or threes at determined points of intersection on each said hemisphere; wherein at least one intersection circle is arranged about a respective one of said points of intersection of 3 of said equatorial circular arcs.

2. A golf ball according to claim 1, wherein a said intersection circle is arranged respectively about each of said points of intersection of 3 of said equatorial circular arcs.

3. A golf ball according to claim 1, wherein said equatorial circular arcs of one of said hemispheres are angularly displaced, with respect to the respectively corresponding ones of said circular arcs of the other of said hemispheres by the same amount about an axis of said determined circular arc.

4. A golf ball according to claim 3, wherein said determined equatorial circle is centred on an axis passing through respective centres of two diametrically opposed faces of said cube and said amount is 45°.

5. A golf ball according to claim 1, wherein said intersection circles are distributed according to an identical motif in said identical elemental surfaces.

6. A golf ball according to claim 1, wherein, in a first said elemental surface, said motif comprises several mutually neighbouring rows of which a first is adjacent to a hypothenuse of said spherical right-angle triangle and of which each mutually connects two edges of a right angle of said spherical right-angle triangle and has a respective determined number of regularly distributed ones of said intersection circles of the same diameter, said determined number being for each row less by one unit than said determined number of said intersection circles in a respectively neighbouring one of said rows nearer said hypothenuse and each said intersection circle of each said row being adjacent at two of said intersection circles of said respectively neighbouring row nearer said hypothenuse.

7. A golf ball according to claim 6, wherein said first row comprises 4 mutually adjacent ones of said intersection circles, adjacent said hypothenuse of said spherical right-angle triangle and of which two end ones of said intersection circles are further respectively adjacent to one and the other of said sides of said right angle of said spherical right-angle triangle, said rows further comprising:

a second row of 3 mutually disjoint ones of said intersection circles, of which each is adjacent to two of said intersection circles of said first row and of which two end ones of said intersection circles are further respectively adjacent to the one and the other of said sides of said right angle of said spherical right-angle triangle, a third row of 2 mutually disjoint ones of said intersection circles of which each is adjacent to two of said intersection circles of said second row and respectively to the one and the other of said sides of said right angle of said spherical right-angle triangle, one single one of said intersection circles adjacent to said 2 intersection circles of said third row and to said two sides of said right angle of said spherical right-angle triangle, respective diameters of said intersection circles of said first and second rows and of said single intersection circle being substantially identical and less than said diameter of said intersection circles of said first row.

8. A golf ball according to claim 7 in combination, wherein the diameter of said intersection circles of a second one of said elemental surfaces is intermediate between the respective diameters of said intersection circles of said first row of a first one of said elemental surfaces and of said intersection circles of said second and third rows of a first one of said elemental surfaces.

9. A golf ball according to claim 1, wherein, a median circular arc of a second elemental surface is defined as a circular arc centred on said centre of said sphere and joining an apex of said spherical equilaterial triangle to a midpoint of an opposite side of this, said motif comprising, in a second one of said elemental surfaces:

first ones of said intersection circles distributed in an identical manner on said median circular arcs, second ones of said intersection circles distributed in rows of which each mutually connects two of said first intersection circles occupying identical positions on corresponding ones of said median circular arcs.

10. A golf ball according to claim 9, wherein two first ones of said intersection circles occupying identical positions on said corresponding median circular arcs, in a second one of said elemental surfaces, have the same diameter.

11. A golf ball according to claim 9, wherein two of said rows occupying identical positions in a second one of said elemental surfaces are identical.

12. A golf ball according to claim 9, wherein said intersection circles of the same said row, in a second one of said elemental surface have the same diameter.

13. A golf ball according to claim 9, wherein said intersection circles have the same diameter in a second one of said elemental surfaces.

14. A golf ball according to claim 9, including an intersection circle situated about a point of intersection of 3 of said equatorial circular arcs is adjacent to two of said intersection circles of which each is situated in a respective one of said second elemental surfaces and constitutes one of said intersection circles.

15. A golf ball according to claim 1, wherein a second of said elemental surfaces comprises 15 identical ones of said intersection circles, distributed in:

3 rows of which each passes along one respective side of said spherical equilateral triangle and has 5 of said intersection circles adjacent in pairs and adjacent to said side, two end ones of said intersection circles of each of said rows being common at two other respective ones of said rows and being adjacent to two other respective ones of said sides of said spherical equilateral triangle, 3 of said intersection circles adjacent in pairs and of which each is also adjacent to two respective ones of said intersection circles of two of said 3 rows.

16. A golf ball according to claim 15, including an intersection circle situated about a point of intersection of 3 of said equatorial circular arcs, which is adjacent to two of said intersection circles of which each is situated in a respective one of said second elemental surfaces and constitutes, in this second said elemental surface, one of said end intersection circles.

17. A golf ball according to claim 14 in combination, wherein the diameter of said intersection circles of a second one of said elemental surfaces is intermediate between the respective diameters of said intersection circles of said first row of a first one of a said elemental surfaces and of said intersection circles of said second and third rows of a first one of said elemental surfaces.

* * * * *